US006600894B2

(12) United States Patent
Takahashi et al.

(10) Patent No.: US 6,600,894 B2
(45) Date of Patent: Jul. 29, 2003

(54) METHOD AND APPARATUS FOR FORMING IMAGE, AND METHOD FOR ABSORBING TRANSCRIPTIONAL MATERIAL

(75) Inventors: Masashi Takahashi, Yokohama (JP); Minoru Yoshida, Machida (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 120 days.

(21) Appl. No.: 09/725,944

(22) Filed: Nov. 30, 2000

(65) Prior Publication Data

US 2002/0154924 A1 Oct. 24, 2002

(51) Int. Cl.[7] ..... G03G 15/00
(52) U.S. Cl. ..... 399/303; 399/66; 399/312
(58) Field of Search ..... 399/66, 299, 303, 399/304, 306, 311, 312, 313, 314, 316

(56) References Cited

U.S. PATENT DOCUMENTS 5,930,556 A * 7/1999 Imamiya ..... 399/66
6,157,795 A 12/2000 Kadonaga et al. ..... 399/66
6,198,899 B1 3/2001 Takahashi et al. ..... 399/303

FOREIGN PATENT DOCUMENTS

| | | |
|---|---|---|
| JP | 4-121767 | 4/1992 |
| JP | 10-186878 | 7/1998 |
| JP | 11-161044 | 6/1999 |

* cited by examiner

*Primary Examiner*—Hoang Ngo
(74) *Attorney, Agent, or Firm*—Foley & Lardner

(57) ABSTRACT

A convey belt is charged only while a sheet is placed and chucked on it. A transfer member for applying a transfer bias is grounded while a transfer bias is not applied, and an electric field is formed on the transfer member side, so that discharge from the surface of the convey belt to the photosensitive body side is suppressed. While transfer is not performed, a bias lower than the bias applied during transfer is applied to the transfer member, so the potential of the transfer member becomes lower than the surface potential of the convey belt. The polarity of the charges applied to charge the convey belt is set to be equal to that of charges applied to charge the photosensitive body. While chucking a sheet, the surface of the convey belt is charged. During the remaining period, an AC bias is applied to the convey belt in order to remove charges from the surface of the convey belt. With any one of the above arrangements, high quality image formation is enabled.

8 Claims, 3 Drawing Sheets

METHOD AND APPARATUS FOR FORMING IMAGE, AND METHOD FOR ABSORBING TRANSCRIPTIONAL MATERIAL

BACKGROUND OF THE INVENTION

The present invention relates to a method and apparatus for forming an image by belt transfer, which are used in an electrophotographic copying machine, printer, and the like, and transfer medium chucking method.

In particular, the present invention relates to a method and apparatus for forming an image by belt transfer, which are used in a four-drum tandem color copying machine, printer, and the like, and a transfer medium chucking method of electrostatically chucking a sheet with a transfer belt by charging the surface of the transfer belt by applying charges to it.

As a transfer technique in an electrophotographic image forming apparatus, a method using a corona charger opposing a photosensitive body is known.

This method, however, generates toxic ozone. As an ozone-free transfer technique, one employing a contact method has been proposed.

Japanese Patent Laid-Open No. 6-110343 discloses a technique in which a semiconductive transfer belt and a transfer roller disposed behind the transfer belt are used and transfer is performed by applying a transfer bias to the transfer roller.

As a color image forming apparatus for forming a color image by using a plurality of toners, i.e., Y (yellow), M (magenta), C (cyan), and Bk (black), the following methods are known:

(1) A method of forming four color images on one photosensitive body to superpose them on each other and transferring them at once.

(2) A transfer drum method of holding a transfer medium on a transfer drum and forming a four-color image by rotating the transfer drum four times.

(3) An intermediate transfer body method of forming four color images on an intermediate transfer body and transferring them on a transfer medium at once.

(4) A four-drum method with which four photosensitive bodies are arranged parallel to each other and a four-color image is formed while a transfer medium passes among them.

According to a color image forming apparatus employing the four-drum method, color images formed on four parallel image carriers can be transferred onto a transfer medium in a multiple manner while the transfer medium passes among them, thereby forming a color image. Therefore, an image can be formed with a time ¼ that required by other processes that form a four-color image. This apparatus is suitable for a higher speed process.

In a color image forming apparatus employing the four-drum method that forms Y, M, C, and Bk toner images with four parallel photosensitive drums, a process unit for forming a monochromatic image is provided, so the service life of the process units for forming color images can be prolonged, leading to a cost reduction.

When forming a monochromatic image, a transfer belt and first, second, and third color image forming photosensitive bodies are separated from each other, and only the fourth black image forming photosensitive body is brought into contact with the transfer belt. Then, the operations of the process units for forming color images are stopped. The transfer belt and color image forming photosensitive bodies are separated from each other in order to prevent wear of the transfer belt and color image forming photosensitive bodies.

In the four-drum type image forming apparatus, since four photosensitive bodies are arranged parallel to each other, the distance for which the transfer medium is conveyed by the transfer belt is, e.g., 300 mm or more. When forming a monochromatic image, if the transfer belt and the color image forming photosensitive bodies are separated from each other, after the transfer medium is fed, it must be conveyed on the transfer belt.

A sheet chucking unit is required to stably convey the transfer medium on the transfer belt. In a conventional chucking unit, a transfer belt and transfer medium are sandwiched together, and charges are applied by a charger, thereby chucking the transfer medium.

With this chucking unit, the charges applied to the surface of the transfer belt for the purpose of sheet chucking are discharged in the transfer section to the upper surface side of the photosensitive body. As a result, charges of opposite polarity to that of the image forming charges applied to the photosensitive body are applied. This causes defective charging in the photosensitive body to lead to an image defect.

SUMMARY OF THE INVENTION

It is an object of the present invention to provide a method and apparatus for forming an image, which are capable of preventing an image defect caused by defective charging which occurs when charges applied to the surface of a convey belt for the purpose of sheet chucking are discharged to the surface of a photosensitive body, and a transfer medium chucking method.

An apparatus for forming an image according to the present invention comprises a plurality of image carriers on which a toner image is to be formed, a developing unit for forming a toner image on the image carriers, a convey belt disposed in contact with the image carriers and adapted to convey a transfer medium, a chucking unit for electrostatically chucking the transfer medium onto the convey belt, and a transfer unit for transferring the toner image from the image carriers to the transfer medium in a transfer region where the image carriers are in contact with the convey belt, the chucking unit having a charger for applying charges to a surface of the convey belt, and a countercharge applying unit for applying countercharges necessary to electrostatically chuck the transfer medium onto the convey belt, wherein the charger starts charge application to the surface of the convey belt such that that portion on the surface of the convey belt to which the charges are applied by the charges reaches the countercharge applying unit at substantially the same timing as a timing at which a leading end of the fed transfer medium reaches the countercharge applying unit, and the charger ends charge application to the surface of the convey belt such that that portion on the surface of the convey belt to which the charges have are applied passes through the countercharge applying unit at substantially the same timing as a timing at which a trailing end of the transfer medium passes through the countercharge applying unit.

The apparatus may have a color mode in which a color image is formed by using four color toners including yellow, magenta, cyan, and black, and a monochromatic mode in which a monochromatic image is formed by using black toner, in the monochromatic mode, the convey belt and, of the plurality of image carriers, an image carrier on which a toner image is to be formed with a color toner may be separated from each other, and the transfer medium may be chucked onto the convey belt by the chucking unit only in the monochromatic mode.

An apparatus for forming an image according to the present invention comprises a plurality of image carriers on which a toner image is to be formed, a developing unit for forming a toner image on the image carriers, a convey belt disposed in contact with the image carriers and adapted to convey a transfer medium, a chucking unit for electrostatically chucking the transfer medium onto the convey belt, and a transfer unit to which a bias is applied in a transfer region where the image carriers are in contact with the convey belt, to transfer the toner image from the image carriers to the transfer medium, the transfer unit being electrically grounded while the bias is not applied thereto.

The apparatus may have a color mode in which a color image is formed by using four color toners including yellow, magenta, cyan, and black, and a monochromatic mode in which a monochromatic image is formed by using black toner, in the monochromatic mode, the convey belt and, of the plurality of image carriers, an image carrier on which a toner image is to be formed with a color toner may be separated from each other, and the transfer unit may be electrically grounded only in the monochromatic mode while the bias is not applied thereto.

An image forming apparatus according to the present invention may comprise a plurality of image carriers on which a toner image is to be formed, a developing unit for forming a toner image on the image carriers, a convey belt disposed in contact with the image carriers and adapted to convey a transfer medium, a chucking unit for electrostatically chucking the transfer medium onto the convey belt, and a transfer unit to which a bias is applied in a transfer region where the image carriers are in contact with the convey belt, to transfer the toner image from the image carriers to the transfer medium, wherein the apparatus may have a color mode in which a color image is formed by using four color toners including yellow, magenta, cyan, and black, and a monochromatic mode in which a monochromatic image is formed by using black toner, and in the monochromatic mode, the convey belt and, of the plurality of image carriers, an image carrier on which a toner image is to be formed with a color toner may be separated from each other, and the chucking unit may chuck the transfer medium onto the convey belt, and a first bias for transferring the toner image may be applied to the transfer unit while the transfer image is being transferred from the image carrier to the transfer medium, and a second bias lower than the first bias may be applied to the transfer unit while transfer of the toner image is not performed.

Alternatively, an image forming apparatus according to the present invention comprises a plurality of image carriers on which a toner image is to be formed, a first charging unit for applying charges to surfaces of the image carriers, a developing unit for forming a toner image on the image carriers, a convey belt disposed in contact with the image carriers and adapted to convey a transfer medium, a chucking unit which has a second charging unit for applying charges to a surface of the convey belt and a countercharge applying unit for applying countercharges in order to electrostatically chuck a transfer medium with the convey belt, and electrostatically chucks the transfer medium onto the convey belt, and a transfer unit for transferring the toner image from the image carriers to the transfer medium in a transfer region where the image carriers are in contact with the convey belt, wherein the charges applied to the surfaces of the image carriers by the first charging unit and the charges applied to the surface of the convey belt by the second charging unit have the same polarity.

An image forming apparatus according to the present invention also comprises a plurality of image carriers on which a toner image is to be formed, a developing unit for forming a toner image on the image carriers, a convey belt disposed in contact with the image carriers and adapted to convey a transfer medium, a chucking unit which has a charging unit for applying charges to a surface of the convey belt and a countercharge applying unit for applying countercharges in order to electrostatically chuck a transfer medium with the convey belt, and electrostatically chucks the transfer medium onto the convey belt, and a transfer unit to which a bias is applied in a transfer region where the image carriers are in contact with the convey belt, to transfer the toner image from the image carriers to the transfer medium, wherein the apparatus has a color mode in which a color image is formed by using four color toners including yellow, magenta, cyan, and black, and a monochromatic mode in which a monochromatic image is formed by using black toner, in the monochromatic mode, the convey belt and, of the plurality of image carriers, an image carrier on which a toner image is to be formed with a color toner are separated from each other, and a DC bias is applied to the charging unit while the fed sheet passes near the countercharge applying unit from a leading end to a trailing end thereof, in order to apply charges to the surface of the convey belt, and an AC bias is applied to the charging unit in a remaining period.

According to the present invention, there is provided a transfer medium chucking method of applying charges to a surface of a convey belt by using a charger, and applying countercharges to the convey belt by using a countercharge applying unit, thereby electrostatically chucking a transfer medium onto the convey belt, the method comprising starting charge application to the surface of the convey belt with the charger such that that portion on the surface of the convey belt to which the charges are applied by the charges reaches the countercharge applying unit at substantially the same timing as a timing at which a leading end of the fed transfer medium reaches the countercharge applying unit, and ending charge application to the surface of the convey belt with the charger such that that portion on the surface of the convey belt to which the charges are applied passes through the countercharge applying unit at substantially the same timing as a timing at which a trailing end of the transfer medium passes through the countercharge applying unit.

The method may have a color mode in which a color image is formed by using four color toners including yellow, magenta, cyan, and black, and a monochromatic mode in which a monochromatic image is formed by using black toner, and the transfer medium may be chucked onto the convey belt by the charger and the countercharge applying unit only in the monochromatic mode.

According to the present invention, there is provided an image forming method of forming a toner image on a surface of an image carrier, conveying a transfer medium with a convey belt disposed in contact with the image carrier, and transferring the toner image with a transfer unit to which a bias is applied, from the image carrier to the transfer medium in a transfer region where the image carrier is in contact with the convey, wherein the transfer unit is electrically grounded while the bias is not applied thereto.

The image forming method may have a color mode in which a color image is formed by using four color toners including yellow, magenta, cyan, and black, and a monochromatic mode in which a monochromatic image is formed by using black toner, and the transfer unit may be electrically grounded while the bias is not applied thereto only in the monochromatic mode.

According to the present invention, there is provided an image forming method of forming a toner image on a surface of an image carrier, conveying a transfer medium with a convey belt disposed in contact with the image carrier, and transferring the toner image with a transfer unit to which a bias is applied, from the image carrier to the transfer medium in a transfer region where the image carrier is in contact with the convey belt, wherein the method has a color mode in which a color image is formed by using four color toners including yellow, magenta, cyan, and black, and a monochromatic mode in which a monochromatic image is formed by using black toner, and in the monochromatic mode, a first bias for transferring the toner image is applied to the transfer unit while the transfer image is being transferred from the image carrier to the transfer medium, and a second bias lower than the first bias is applied to the transfer unit while transfer of the toner image is not performed.

According to the present invention, there is provided a transfer medium chucking method of applying charges to a surface of an image carrier, where a toner image is to be formed, by using a first charging unit, applying charges to a surface of a convey belt which conveys a transfer medium, by using a second charging unit, and applying countercharges to the convey belt by using a countercharge applying unit, thereby electrostatically chucking the transfer medium onto the convey belt, wherein the charges applied to the surfaces of the image carrier by the first charging unit and the charges applied to the surface of the convey belt by the second charging unit have the same polarity.

Alternatively, according to the present invention, there is provided a transfer medium chucking method of applying charges to a surface of a convey belt by using a charger, and applying countercharges to the convey belt by using a countercharge applying unit, thereby electrostatically chucking a transfer medium onto the convey belt, wherein the method has a color mode in which a color image is formed by using four color toners including yellow, magenta, cyan, and black, and a monochromatic mode in which a monochromatic image is formed by using black toner, and in the monochromatic mode, a DC bias is applied to the charging unit while the fed sheet passes near the countercharge applying unit from a leading end to a trailing end thereof, in order to apply charges to the surface of the convey belt, and an AC bias is applied to the charging unit in a remaining period.

In this manner, the present invention has one of the following arrangements:

(1) The convey belt is charged only while a sheet is placed on it and chucked onto it.

(2) The transfer means for applying a transfer bias is grounded while a transfer bias is not applied, and an electric field is formed on the transfer means side, so that discharge from the surface of the convey belt to the photosensitive body side is suppressed.

(3) While transfer is not performed, a bias lower than the bias applied during transfer is applied to the transfer means, so the potential of the transfer means becomes lower than the surface potential of the convey belt.

(4) The polarity of the charges used to charge the convey belt is set to be equal to that of charges used to charge the photosensitive body.

(5) While chucking a sheet, the surface of the convey belt is charged. During the remaining period, an AC bias is applied to the convey belt in order to remove charges from the surface of the convey belt.

Normally, the charges applied to the surface of the transfer belt for the purpose of chucking the sheet are discharged to the photosensitive body surface side to cause defective charging, leading to an image defect. According to the present invention, the problem of image defect can be solved with one of the above arrangements.

BRIEF DESCRIPTION OF THE DRAWINGS

In the accompanying drawings.

DESCRIPTION OF THE PREFERRED EMBODIMENT

A method and apparatus for forming an image, and a transfer medium chucking method according to the embodiment of the present invention will be described with reference to the accompanying drawings.

Figure 1:
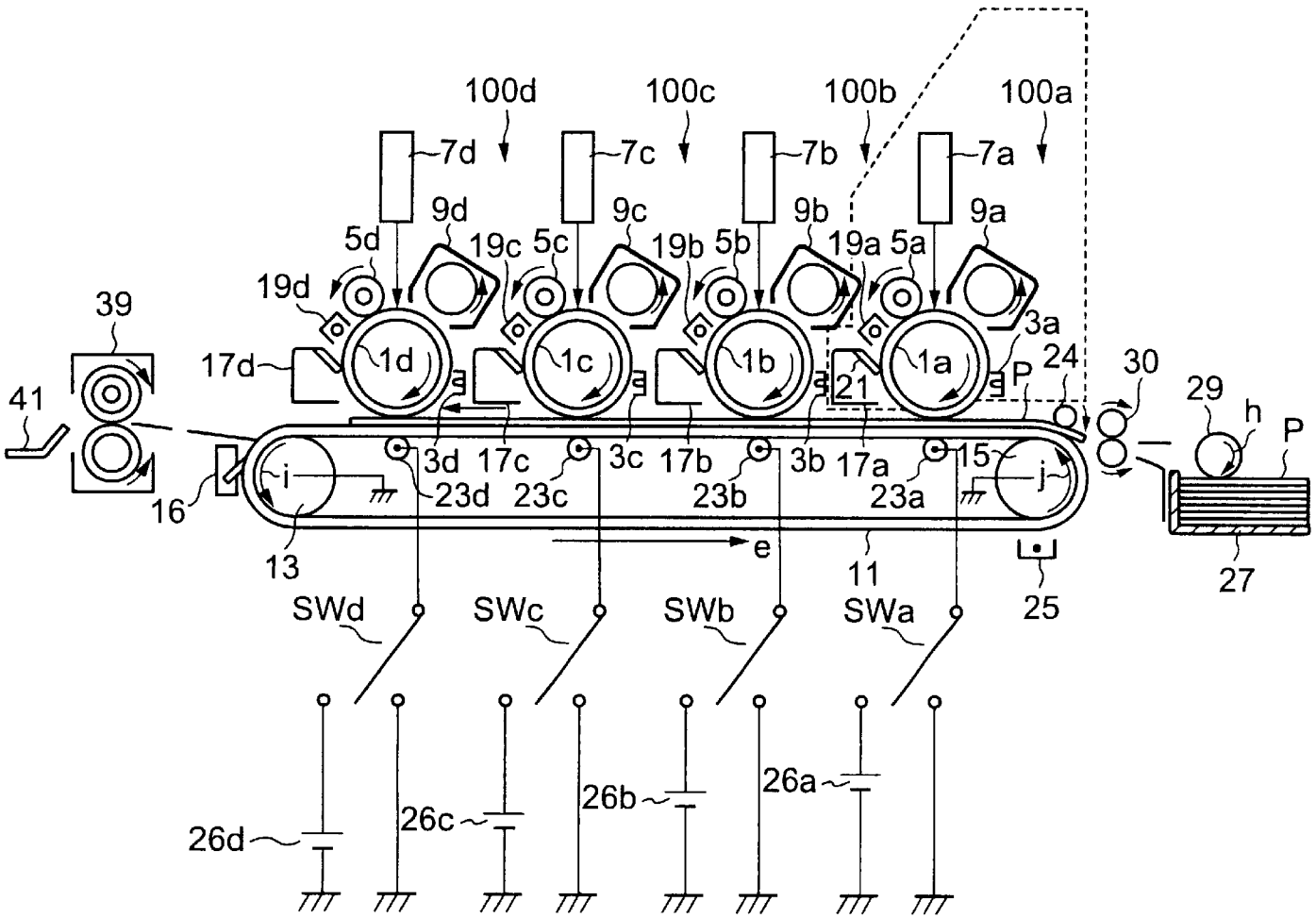
FIG. 1 is a longitudinal sectional view showing the arrangement of an image forming apparatus according to an embodiment of the present invention.

FIG. 1 shows the arrangement of the image forming apparatus according to this embodiment. This apparatus has, as image forming means, four process units 100*a,* 100*b,* 100*c,* and 100*d.*

The process units 100*a,* 100*b,* 100*c,* and 100*d* respectively have photosensitive drums 1*a,* 1*b,* 1*c,* and 1*d* serving as image carriers. An electrostatic latent image is formed on the surface of each of the photosensitive drums 1*a,* 1*b,* 1*c,* and 1*d* by using a developer mix.

The process units 100*a* to 100*d* have the same arrangement, and the process unit 100*a* will be exemplified.

The process unit 100*a* has the photosensitive drum 1*a,* a charger 5*a,* an exposure unit 7*a,* a developing unit 9*a,* a cleaner 17*a,* and a charge removal lamp 19*a.*

For example, the photosensitive drum 1*a* has a cylindrical shape with a diameter of 30 mm, and can rotate in a direction indicated by an arrow.

Components as follows are disposed around the photosensitive drum 1*a* in the rotating direction. The charger 5*a* faces the photosensitive drum 1*a* to be in contact with its surface. The charger 5*a* uniformly charges the photosensitive drum 1*a* to negative polarity.

The exposure unit 7*a* is disposed on the downstream side (right in FIG. 1) of the charger 5*a,* to expose the charged photosensitive drum 1*a,* thereby forming an electrostatic latent image.

The developing unit 9*a,* which contains a yellow developer mix, and converts and develops the electrostatic latent image formed by the exposure unit 7*a,* is disposed on the downstream side of the exposure unit 7*a.*

A convey belt 11 serving as a conveying means for conveying to the photosensitive drum 1*a* a sheet P as a medium where an image is to be formed is disposed on the downstream side of the developing unit 9*a*.

The convey belt 11 conveys the sheet P to the photosensitive drum 1*a* so that the toner image formed on the photosensitive drum 1*a* comes into contact with the sheet P.

The cleaner 17*a* and charge removal lamp 19*a* are disposed on the downstream side of a position where the photosensitive drum 1*a* and sheet P are in contact with each other.

The cleaner 17*a* has a blade 21. After transfer, the cleaner 17*a* removes the developer mix, left on the photosensitive drum 1*a,* by scraping it with the blade 21.

After transfer, the charge removal lamp 19*a* removes charges on the surface of the photosensitive drum 1*a* by uniform light irradiation. When charge removal with the charge removal lamp 19*a* is ended, one cycle of image formation is complete. In the next image forming process, the charger 5*a* uniformly charges the non-charged photosensitive drum 1*a* again.

The convey belt 11 has, in a direction crossing the convey direction (direction of an arrow e) of the sheet P and perpendicular to the surface of the sheet, a width substantially equal to the dimension of the photosensitive drum 1*a* in the longitudinal direction.

The convey belt 11 has the shape of a seamless belt. The convey belt 11 is carried on the surfaces of a driving roller 13 and driven roller 15 and is pivoted at a predetermined speed.

The distance from the driving roller 13 to the driven roller 15 is, e.g., about 300 mm. The driving roller 13 and driven roller 15 can rotate in the directions of arrows i and j, respectively. When the driving roller 13 rotates, the convey belt 11 rotates, and the driven roller 15 rotates by rotation of the convey belt 11.

Since the driven roller 15 applies a pressure to the right in FIG. 15, a tension acts on the convey belt 11, so the convey belt 11 can rotate without slipping. The convey belt 11 is made of 100-$\mu$m thick polyimide uniformly dispersed with carbon, and has an electric resistance of $10^{10}$ Ω·cm, thus exhibiting semiconductive characteristics.

The material used to form the convey belt is not limited to carbon-dispersed polyimide, but can be any material as far as it has semiconductive characteristics with a volume resistivity of $10^{9}$ Ω·cm to $10^{13}$ Ω·cm. For example, a material obtained by dispersing conductive particles of carbon or the like in polyethylene terephthalate, polycarbonate, polytetrafluoroethylene, polyvinylidene fluoride, or the like can be used.

Alternatively, a polymeric film, the electric resistance of which is adjusted by adjusting the composition and not by dispersing conductive particles in it, may be used.

Furthermore, a material obtained by mixing an ionic conductive material in such a polymeric film, or a rubber material, e.g., silicone rubber or urethane rubber, with a comparatively low electric resistance may be used.

On the convey belt 11, in addition to the process unit 100*a,* the process units 100*b,* 100*c,* and 10*d* are arranged between the driving roller 13 and driven roller 15 in the convey direction of the sheet P, as described above. Each of the process units 100*b,* 100*c,*and 100*d* has the same arrangement as that of the process unit 100*a*. The photosensitive drums 1*a* to 1*d* of the respective process units 100*a* to 100*d* are arranged at substantially the central positions of the respective process units 100*a* to 100*d*.

Chargers 5*b* to 5*d* are respectively provided around the photosensitive drums 1*b* to 1*d,* exposure units 7*b* to 7*d* are respectively provided on the downstream side of the chargers 5*b* to 5*d,* and developing units 9*b* to 9*d,* cleaners 17*b* to 17*d,* and charge removal lamps 19*b* to 19*d* are respectively provided on the downstream sides of the exposure units 7*b* to 7*d*.

The developer mixes stored in the respective developing units of the process units 100*a* to 100*d* differ. The developing units 9*a,* 9*b,* 9*c,* and 9*d* respectively contain yellow, magenta, cyan, and black developer mixes. When forming a monochromatic image, only the process unit 100*d* is used. When forming a color image, the process units 100*a* to 100*d* are used.

The sheet P conveyed by the convey belt 11 sequentially comes into contact with the respective photosensitive drums.

Near positions where the sheet P is in contact with the photosensitive drums 1*a* to 1*d,* transfer members 23*a* to 23*d* serving as transfer means are disposed to correspond to the respective photosensitive drums 1*a* to 1*d*.

More specifically, the transfer member 23*a* is provided under the corresponding photosensitive drum 1*a,* to come into contact with the rear surface of the convey belt 11, and opposes the process unit 100*a* through the convey belt 11.

The transfer members 23*b* to 23*d* are respectively connected to positive (+) DC power supplies 26*a* to 26*d,* serving as voltage applying means, through high-voltage relay switches SWa to SWd.

How to switch connection of the DC power supplies 26*a* to 26*d* to the transfer members 23*a* to 23*d* will be described.

The transfer members 23*a* to 23*d* are connected to the bias-applying DC power supplies 26*a* to 26*d,* or grounded by the switches SWa to SWd.

Normally, the metal cores of the transfer rollers of the transfer members 23*a* to 23*d* are grounded through the switches SWa to SWd.

After the printing operation is started, when the developed toner images formed on the photosensitive drums 1*a* to 1*d* are to be transferred to the transfer rollers, the bias application electrodes (metal cores) of the transfer rollers are connected to the DC power supplies 26*a* to 26*d* through the switches Swa to SWd and, for example, 1,100 (V) is applied to them as a transfer bias.

When toner transfer to the transfer rollers is ended, outputs from the DC power supplies 26*a* to 26*d* are stopped at this timing, and the switches SWa to SWd are switched to connect the metal cores of the respective transfer rollers to the ground side again.

More specifically, when a pair of registration rollers 30 feed a sheet, the timer starts counting simultaneously. When a convey time expressed by the product of a belt convey speed Vb (m/sec) and a distance Lk (mm) from the nip of the pair of registration rollers 30 to the fourth transfer region elapses, the DC power supplies 26*a* to 26*d* start applying bias voltages. The transfer biases are applied for a time corresponding to the length of the sheet, so that the toner on the photosensitive drums 1*a* to 1*d* is transferred to the sheet.

When transfer is ended, application of the transfer biases is stopped simultaneously. The metal cores of the transfer members 23*a* to 23*d* connected to the DC power supplies 26*a* to 26*d* are grounded as they are switched by the switches SWa to SWd.

A sheet cassette 27 for accommodating sheets P is provided on the right side of the convey belt 11 in FIG. 1. A pickup roller 29 for picking up sheets P from the sheet cassette 27 one by one is provided near the sheet cassette 27 to be rotatable in a direction of an arrow h.

The pair of two opposing registration rollers 30 are rotatably provided between the pickup roller 29 and convey belt 11. The pair of registration rollers 30 supply a sheet P onto the convey belt 11 at a predetermined timing.

A metal roller 24 for electrostatically chucking the sheet P onto the surface of the convey belt 11 is arranged on the convey belt 11. The metal roller 24 is grounded.

Under the driven roller 15, a charger 25 is provided through the convey belt 11. The charger 25 serves to charge the belt for the purpose of sheet chucking, and uses the driven roller 15 as a counterelectrode.

A fixing unit 39 for fixing the developer mix onto the sheet P and a discharge tray 41 to which the sheet P fixed by the fixing unit 39 is discharged are provided to the left side of the convey belt 11 in FIG. 1.

The color image forming process of the image forming apparatus with the above arrangement will be described.

When the operator instructs start of image formation through an operation panel (not shown), the photosensitive drum 1*a* starts rotation upon reception of a driving force from a driving mechanism (not shown).

The charger 5*a* uniformly charges the photosensitive drum 1*a* to about −600 (V). Light from the exposure unit 7*a* and corresponding to an image to be recorded irradiates the surface of the photosensitive drum 1*a* uniformly charged by the charger 5*a,* and forms an electrostatic latent image.

The developing unit 9*a* develops this electrostatic latent image with a developer mix, and forms a yellow toner image.

Toner images of the respective colors are formed on the surfaces of other photosensitive drums 1*b* to 1*d* as well in accordance with the same procedure as that employed when forming the toner image on the surface of the photosensitive drum 1*a*.

The pickup roller 29 picks up a sheet P from the sheet cassette 27. The pair of registration rollers 30 feed the picked sheet P onto the convey belt 11.

The convey belt 11 sequentially conveys the fed sheet P toward the photosensitive drums 1*a,* 1*b,* 1*c,* and 1*d.*

When the sheet P reaches the first transfer region formed by the photosensitive drum 1*a,* convey belt 11, and transfer member 23*a,* the DC power supply 26*a* supplies a bias voltage of about +1,000 V to the transfer member 23*a.* This forms a transfer electric field between the transfer member 23*a* and photosensitive drum 1*a.* The toner image on the surface of the photosensitive drum 1*a* is transferred to the sheet P in accordance with the transfer electric field.

The sheet P to which the toner image has been transferred in the transfer region is conveyed toward the next second transfer region formed by the photosensitive drum 1*b,* convey belt 11, and transfer member 23*b.*

In the second transfer region, the DC power supply 26*b* applies a bias voltage of about +1,200 V to the transfer member 23*b* so as to transfer a magenta toner image on the already formed yellow toner image.

After the magenta toner image is transferred, the sheet P is further conveyed toward the next third transfer region.

In the third transfer region, the DC power supply 26*c* applies a bias voltage of about +1,400 V to the transfer member 23*c* so as to form a cyan toner image on the already formed yellow and magenta toner images.

After the cyan toner image is transferred, the sheet P is further conveyed toward the last fourth transfer region.

In the four transfer region, the DC power supply 26*d* applies a bias voltage of about +1,600 V to the transfer member 23*d* so as to form a black toner image on the already formed magenta, yellow, and cyan toner images.

The yellow, magenta, cyan, and black toner images formed in this manner by multiple transfer are fixed on the sheet P by the fixing unit 39, thus forming a color image.

After fixing, the sheet P is discharged onto the discharge tray 41.

Figure 2:
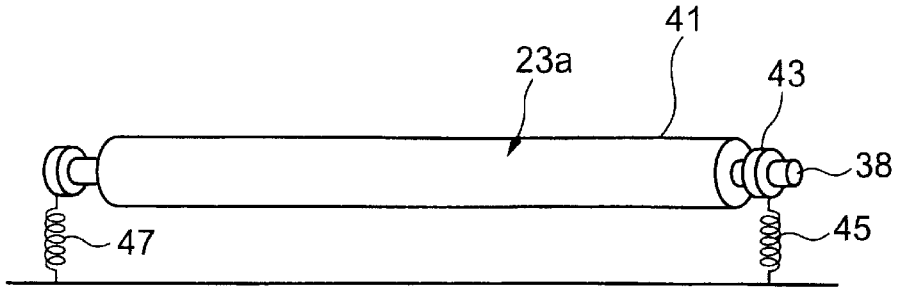
FIG. 2 is a view showing the arrangement of a transfer member in the image forming apparatus.

The arrangements of the transfer members 23*a* to 23*d* will be described with reference to FIG. 2.

The transfer member 23*a* is a conductive foamed urethane roller which is dispersed with carbon as described above to have conductivity. A 16-mm diameter discharge roller 41 is molded on a 6-mm diameter metal core 38. The electric resistance between the metal core 38 and the surface of the roller 41 is about 106 Ω. A bearing 43 for receiving a rotating shaft is provided to the metal core 38. The metal core 38 is connected to the constant-voltage DC power supply 26*a.*

The power feed member used in the transfer member 23*a* is not limited to a conductive roller but can be a conductive brush, rubber plate, sheet, or the like.

When a conductive sheet is used, it may be a carbon-dispersed rubber member or resin film. For example, the conductive sheet can be a rubber member made of silicone rubber, urethane rubber, or EPDM, or a resin member made of polycarbonate or the like. A conductive sheet with a volume resistivity of $10^5$ Ω·cm to $10^7$ Ω·cm is preferable.

In this embodiment, the roller 41 is arranged such that its center is immediately under the photosensitive body in the vertical direction passing through the center of the photosensitive body. Springs 45 and 47 serving as biasing means are provided to the two ends of the rotating shaft of the roller 41. The springs 45 and 47 bias the transfer member 23*a* so as to bring it into contact with the convey belt 11 elastically in the vertical direction.

The biasing force generated by the springs 45 and 47 provided to the roller 41 of each of the transfer members 23*a* to 23*d* can be, e.g., 1,000 gft. Note that the biasing force is the total of the biasing force of 500 gft generated by the spring 45 and the biasing force of 500 gft generated by the spring 47.

The arrangements of the transfer members 23*b,* 23*c,* and 23*d* are identical to that of the transfer member 23*a* described above, and the arrangements with which the transfer members 23*b,* 23*c,* and 23*d* elastically abut against the convey belt 11 are also identical to that of the transfer member 23*a* described above. Hence, a description concerning the arrangements of the transfer members 23*b,* 23*c,* and 23*d* will be omitted.

An image forming process in formation of a monochromatic image will be described.

When the operator selects the monochromatic mode through the operation panel of the image forming apparatus, or when the image forming apparatus analyzes image data by prescanning before copying and detects that the original includes only black color, the apparatus operates in the monochromatic mode. In this case, image formation is performed by using, among the process units 100*a* to 100*d,* only the process unit 100*d.*

When the monochromatic mode is set, (1) separation of the transfer belt unit is performed first, and then (2) chucking of the transfer medium is performed.

(1) Separation of Transfer Belt Unit

The transfer unit comprised of the convey belt 11, driving roller 13, and driven roller 15 performs separation while maintaining the convey belt 11 taut.

Figure 3:
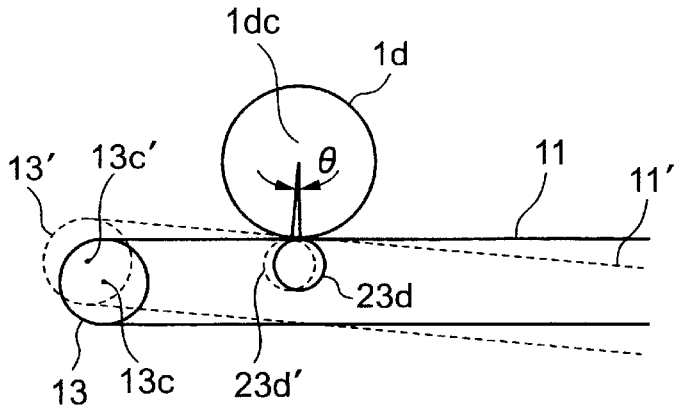
FIG. 3 is a view showing how a transfer belt separates from a color photosensitive drum in a monochromatic-mode image forming process in the image forming apparatus.

More specifically, the rotating shaft of the driven roller 15 is pushed down by a cam mechanism (not shown), and simultaneously, a rotating shaft 13*c* of the driving roller 13 moves along a grooved frame which is at a constant distance from a rotation center 1*dc* of the fourth photosensitive drum 1*d,* as shown in FIG. 3, to become a rotating shaft 13*c* '. The driving roller 13 and convey belt 11 move to the positions of a driving roller 13' and convey belt 11' indicated by broken lines in FIG. 3.

The photosensitive drum 1*d* rotates through an angleθ about its center 1*dc* as the rotation center, so the transfer member 23*d* moves to the position of a transfer member 23*d*' indicated by a broken line. Although the contact between the photosensitive drum 1*d* and convey belt 11 changes, the planar shape of the convey belt 11 does not deform, and the convey belt 11 separates from the first, second, and third photosensitive drums 1*a,* 1*b,* and 1*c*.

As the convey belt 11 separates, the position of the transfer region formed by the convey belt 11 and fourth photosensitive drum 1*d* shifts to the downstream side of the photosensitive drum 1*d*.

Consequently, the sheet P reaches the transfer region with a slight delay. Hence, the timing of image formation performed by the fourth process unit must be corrected such that this image formation is performed at a timing later than in the color mode.

(2) Chucking of Transfer Medium

In the monochromatic mode, a sheet chucking step is indispensable, unlike in the color mode. In the color mode, the four photosensitive drums 1*a* to 1*d* are in contact with the convey belt 11, and the sheet is conveyed among them. Hence, although the chucking step can be performed, it is not always necessary.

In contrast to this, in the monochromatic mode, since only the fourth photosensitive drum 1*d* comes into contact with the convey belt 11, as described above, the sheet must be conveyed by the chucking step until it reaches the photosensitive drum 1*d*.

Figure 4:
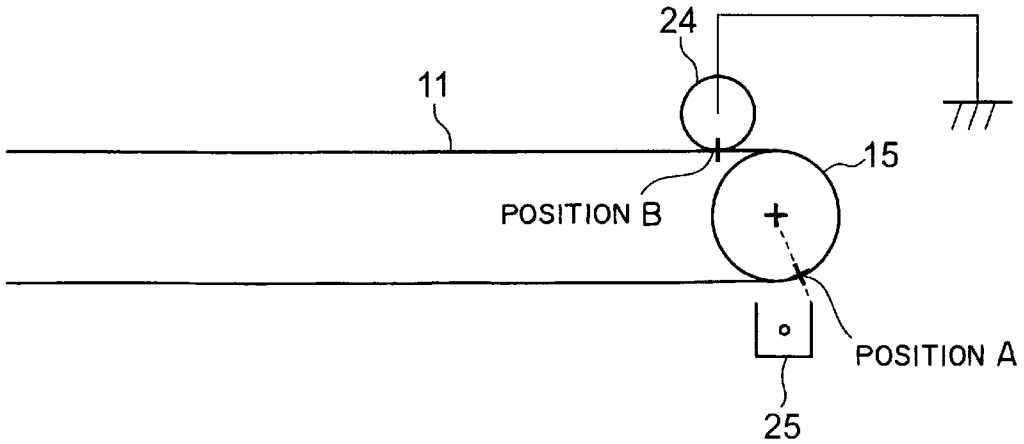
FIG. 4 is a view showing how a sheet is chucked by the transfer belt in the monochromatic-mode image forming process in the image forming apparatus.

The chucking operation of the transfer medium will be described with reference to FIG. 4. Upon printing, a power supply (not shown) applies a bias to the charger 25. Thus, the surface of the convey belt 11 is charged to perform the first chucking step.

The charger 25 includes a corona charger (not shown). This color charger applies a bias of +5 (kV) to the wire.

The leading end of the sheet fed by the pair of registration rollers 30 reaches a portion (position B) between the convey belt 11 and the conductive ground roller 24 which is grounded.

Since the leading end of the sheet is sandwiched by the positively charged convey belt 11 and the conductive ground roller 24, counter charges (−) are generated on, of the surfaces of the sheet, that surface which is in contact with the conductive ground roller, to electrically chuck the sheet with the surface of the convey belt 11. Hence, the second chucking step is performed.

In the second chucking step, other process units 100*a* to 100*c* do not operate at all.

The timing of the chucking operation of the first chucking step will be described with reference to the timing chart of FIG. 5.

A transfer belt motor (not shown) for rotating the driving roller 13, and a drum motor (not shown) for rotating the photosensitive drum 1*d* for monochromatic image formation start operation at time point t1, and keep rotating until time point t21.

The pair of registration rollers 30 rotate from time point t4 at which a leading end F1 of the sheet P reaches them until time point t8 slightly after time point t6 at which a trailing end E1 of the sheet P passes between them. The pair of registration rollers 30 also rotate from time point t11 at which a leading end F2 of the next sheet P reaches them until time point t17 slightly after time point t14 at which a trailing end E2 of the sheet P passes between them.

The chucking operation is controlled with reference to, as references (0), the timing at which the pair of registration rollers 30 start rotating since time points t4 and t11 in order to start paper feed.

Let T (sec) be the time required for the leading end F1 or F2 of the fed sheet P to pass through the nip of the pair of registration rollers 30 and reach the conductive ground roller 24 since the reference (0), Vb (mm/sec) be the belt convey speed, and L (mm) be the distance from a position A on the convey belt 11, which the distal end of the charger 25 opposes, to the contact nip position B of the conductive ground roller 24. Then, a time T0 (sec) during which a voltage is applied to the charger 25 is:

$$T0=T-L/Vb$$

A bias is applied to the charger 25 at timings (time points t5 and t12) time T0 (sec) from the time points t4 and t11, as the reference (0), at which the pair of registration rollers 30 rotate to start paper feed.

When bias application to the charger 25 is controlled at these timings, chucking is started at a timing at which the sheet reaches the conductive ground roller 24.

The position A on the convey belt 11, which opposes the distal end of the charger 25, is a rough position where the convey belt 11 is charged. The bias application timing may be slightly shifted to the downstream side.

Letting M (mm) be the length of the sheet, charge application by the charger 25 is stopped at time points (t7, t16) upon a lapse of M·Vb (sec).

To feed sheets P1, P2, . . . continuously, bias application identical to that described above is performed again at a time point at which a time (time point t11−t4) corresponding to the distance between the current sheet P1 and the next sheet P2 elapses. Thus, control can be performed for any of the sheets P1, P2, . . . , such that charges are applied to the surface of the convey belt 11 at a time point at which the sheet reaches the conductive ground roller 24.

In this manner, the pair of registration rollers 30 rotate from the time point t4 to the time point t8 for the sheet P1, and from the time point t11 to the time point t17 for the sheet P2, so that the sheet is fed. Furthermore, a bias is supplied to the charger 25 from the time point t5 to the time point t7 for the sheet P1, and from the time point t12 to the time point t16 for the sheet P2, so that the chucking operation is performed.

After this, the sheets P1 and P2 are conveyed to the position of the process unit 100*d,* and the exposure unit 7*d* performs an exposure process from time point t9 to time point t13 for the sheet P1, and from time point t18 to time point t19 for the sheet P2. Then, the transfer member 23*d* applies a transfer bias from time point t10 to time point t15 to the sheet P1, and from the time point t18 to time point t20 to the sheet P2. Thus, the toner image formed on the photosensitive drum 1*d* is transferred to the sheets P1 and P2.

Figure 5:
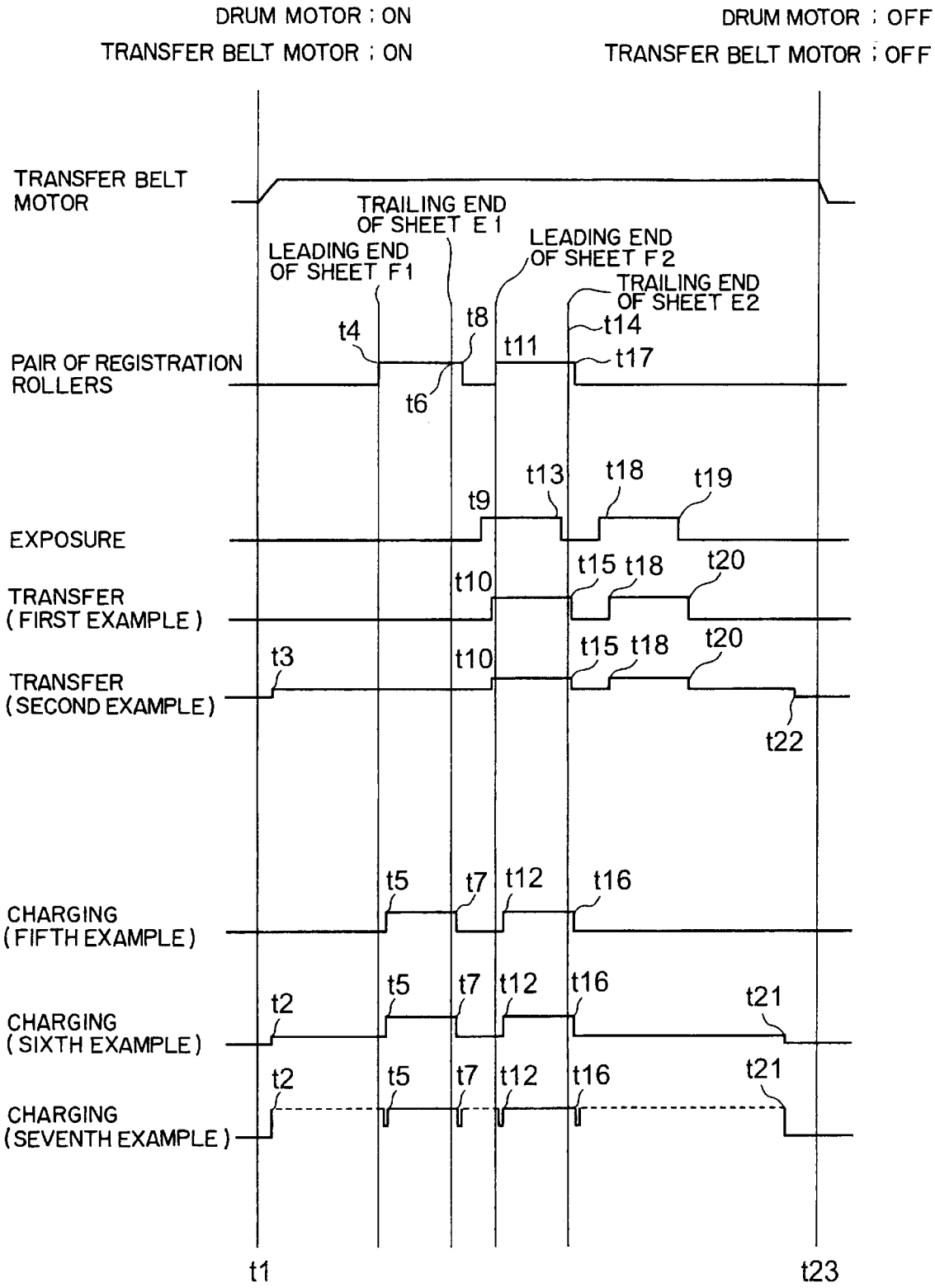
FIG. 5 is a timing chart showing timings concerning chucking operation.

For example, a bias of 1,100 V necessary for transfer is applied to the transfer member 23*d* from time point t10 to time point t15 for the sheet P1, and from the time point t18 to the time point t20 for the sheet P2, as indicated as (Example 1) in FIG. 5. Thus, toner images are transferred to the sheets P1 and P2.

Alternatively, a low bias of 800 V is applied while transfer is not performed, that is, from time point t3 to the time point t10, from the time point t15 to the time point t18, and from time point t20 to time point t22, as indicated as (Second Example) in FIG. 5.

The second bias of 1,100 V is applied to the transfer member 23*d* when the sheets P1 and P2 are conveyed and the toner image on the photosensitive body is to be transferred to them, more specifically, from the time point t10 to the time point t15 for the sheet P1 and from the time point t18 to the time point t20 for the sheet P2, so that the toner images are transferred to the sheets.

After the time points t15 and t20 at which toner image transfer is complete, the bias of 800 V is applied while the convey belt 11 performs conveyance.

In this manner, in (Second Example), a low transfer bias is applied to the transfer member 23*d* even while transfer is not performed.

The timing at which the polarity of the charges applied to the photosensitive drum 1*d* and that of the charges applied to the sheet-chucking convey belt 11 are controlled, will be described.

(Third Example) When the bias applied to the charger 5*d* that charges the photosensitive drum 1*d* is −7 (kV) and the surface of the photosensitive drum 1*d* is uniformly charged to −600 V, a voltage of −5 (kV) is supplied to the charger 25, so the sheet-chucking convey belt 11 is charged negatively.

(Fourth Example) If the photosensitive drum 1 is of positively charged type, when a bias of +7 (kV) is applied to the photosensitive body charger 5 and the photosensitive drum 1 is charged to +500 V, a bias of +5 kv is applied to the charger 25, so the chucking convey belt 11 is charged positively.

A bias may be applied to the charger 25, which charges the surface of the convey belt 11, in the following manner.

As indicated by (Fifth Example) in FIG. 5, the first bias may be applied from the time point t5 to the time point t7 during which the sheet P1 is to be chucked, and from the time point t12 to the time point t16 during which the sheet P2 is to be chucked.

Alternatively, as indicated by (Sixth Example), the first bias may be applied from the time point t5 to the time point t7 during which the sheet P1 is to be chucked, and from the time point t12 to the time point t16 during which the second sheet P2 is to be chucked, and the lower second bias may be applied from the time point t2 to the time point t5, the time point t7 to the time point t12, and from the time point t16 to the time point t21, during which no sheet is to be chucked.

Alternatively, as indicated by (Seventh Example), the first bias as a DC component may be applied while a sheet is chucked, and an AC component may be applied while no sheet is chucked. Then, the surface of the convey belt 11 is charged with the first bias as the DC component while the sheet is chucked, and an AC component is applied to the convey belt 11 during the remaining period, thereby removing the DC component.

More specifically, when printing operation in the monochromatic mode is started, a 2-kvpp, 400-Hz frequency AC bias is simultaneously applied to the charger 25.

When the sheet reaches the conductive ground roller (countercharge applying unit), the bias to be applied to the charger 25 is switched to a −5 (kV) AC bias at this timing.

When the sheet passes through the conductive ground roller, an AC bias is applied to the charger 25 again at this timing.

The AC bias component applied to the charger 25 preferably has a magnitude of 1.4 (kVpp) or more and a frequency of 350 Hz to 550 Hz.

As described above, although the chucking operation is indispensable in the monochromatic mode, it may be performed in the same manner in the color mode as well.

According to the embodiment described above, a low-cost, high-endurance transfer unit can be realized with a simple arrangement, and a high-quality transfer image free from an image defect can be obtained.

What is claimed is:

1. An apparatus for forming an image, comprising:

a plurality of image carriers on which a toner image is to be formed;

a developing unit for forming a toner image on said image carriers;

a convey belt disposed in contact with said image carriers and adapted to convey a transfer medium;

a chucking unit for electrostatically chucking said transfer medium onto said convey belt; and a transfer unit for transferring the toner image from said image carriers to said transfer medium in a transfer region where said image carriers are in contact with said convey belt, said chucking unit having a charger for applying charges to a surface of said convey belt, and a countercharge applying unit for applying countercharges necessary to electrostatically chuck said transfer medium onto said convey belt, wherein said charger starts charge application to said surface of said convey belt such that that portion on said surface of said convey belt to which the charges are applied by said charges reaches said countercharge applying unit at substantially the same timing as a timing at which a leading end of said fed transfer medium reaches said countercharge applying unit, and said charger ends charge application to said surface of said convey belt such that that portion on said surface of said convey belt to which the charges are applied passes through said countercharge applying unit at substantially the same timing as a timing at which a trailing end of said transfer medium passes through said countercharge applying unit.

2. An apparatus according to claim 1, wherein said apparatus has a color mode in which a color image is formed by using four color toners including yellow, magenta, cyan, and black, and a monochromatic mode in which a monochromatic image is formed by using black toner, in the monochromatic mode, said convey belt and, of said plurality of image carriers, an image carrier on which a toner image is to be formed with a color toner are separated from each other, and said transfer medium is chucked onto said convey belt by said chucking unit only in the monochromatic mode.

3. An apparatus for forming an image, comprising:

a plurality of image carriers on which a toner image is to be formed;

a first charging unit for applying charges to surfaces of said image carriers;

a developing unit for forming a toner image on said image carriers;

a convey belt disposed in contact with said image carriers and adapted to convey a transfer medium;

a chucking unit which has a second charging unit for applying charges to a surface of said convey belt and a countercharge applying unit for applying countercharges in order to electrostatically chuck said transfer medium with said convey belt, and electrostatically chucks said transfer medium onto said convey belt; and a transfer unit for transferring the toner image from said image carriers to said transfer medium in a transfer region where said image carriers are in contact with said convey belt, wherein the charges applied to said surfaces of said image carriers by said first charging unit and the charges applied to said surface of said convey belt by said second charging unit have the same polarity.

4. An apparatus for forming an image, comprising:

a plurality of image carriers on which a toner image is to be formed;

a developing unit for forming a toner image on said image carriers;

a convey belt disposed in contact with said image carriers and adapted to convey a transfer medium;

a chucking unit which has a charging unit for applying charges to a surface of said convey belt and a countercharge applying unit for applying countercharges in order to electrostatically chuck a transfer medium with said convey belt, and electrostatically chucks said transfer medium onto said convey belt; and a transfer unit to which a bias is applied in a transfer region where said image carriers are in contact with said convey belt, to transfer the toner image from said image carriers to said transfer medium, wherein said apparatus has a color mode in which a color image is formed by using four color toners including yellow, magenta, cyan, and black, and a monochromatic mode in which a monochromatic image is formed by using black toner, in the monochromatic mode, said convey belt and, of said plurality of image carriers, an image carrier on which a toner image is to be formed with a color toner are separated from each other, and a DC bias is applied to said charging unit while the fed sheet passes near said countercharge applying unit from a leading end to a trailing end thereof, in order to apply charges to said surface of said convey belt, and an AC bias is applied to said charging unit in a remaining period.

5. A transfer medium chucking method of applying charges to a surface of a convey belt by using a charger, and applying countercharges to said convey belt by using a countercharge applying unit, thereby electrostatically chucking a transfer medium onto said convey belt, said method comprising:

starting charge application to said surface of said convey belt with said charger such that that portion on said surface of said convey belt to which the charges are applied by said charges reaches said countercharge applying unit at substantially the same timing as a timing at which a leading end of said fed transfer medium reaches said countercharge applying unit, and ending charge application to said surface of said convey belt with said charger such that that portion on said surface of said convey belt to which the charges are applied passes through said countercharge applying unit at substantially the same timing as a timing at which a trailing end of said transfer medium passes through said countercharge applying unit.

6. A method according to claim 5, wherein said method has a color mode in which a color image is formed by using four color toners including yellow, magenta, cyan, and black, and a monochromatic mode in which a monochromatic image is formed by using black toner, and said transfer medium is chucked onto said convey belt by said charger and said countercharge applying unit only in the monochromatic mode.

7. A transfer medium chucking method of applying charges to a surface of an image carrier, where a toner image is to be formed, by using a first charging unit, applying charges to a surface of a convey belt which conveys a transfer medium, by using a second charging unit, and applying countercharges to said convey belt by using a countercharge applying unit, thereby electrostatically chucking said transfer medium onto said convey belt, wherein the charge applied to said surfaces of said image carrier by said first charging unit and the charges applied to said surface of said convey belt by said second charging unit have the same polarity.

8. A transfer medium chucking method of applying charges to a surface of the convey belt by using a charger, and applying countercharges to said convey belt by using a countercharge applying unit, thereby electrostatically chucking a transfer medium onto said convey belt, wherein said method has a color mode in which a color image is formed by using four color toners including yellow, magenta, cyan, and black, and a monochromatic mode in which a monochromatic image is formed by using black toner, and in the monochromatic mode, a DC bias is applied to said charging unit while the fed sheet passes near said countercharge applying unit from a leading end to a trailing end thereof, in order to apply charges to said surface of said convey belt, and an AC bias applied to said charging unit in a remaining period.

* * * * *